US008240893B2

(12) United States Patent
Lin

(10) Patent No.: US 8,240,893 B2
(45) Date of Patent: Aug. 14, 2012

(54) LED LAMP WITH CLAMP ATTACHMENT ELEMENT

(76) Inventor: Chia-Yun Lin, Taichung (TW)

( * ) Notice: Subject to any disclaimer, the term of this patent is extended or adjusted under 35 U.S.C. 154(b) by 333 days.

(21) Appl. No.: 12/690,227

(22) Filed: Jan. 20, 2010

(65) Prior Publication Data

US 2011/0176309 A1 Jul. 21, 2011

(51) Int. Cl.
*F21V 21/088* (2006.01)

(52) U.S. Cl. ..... 362/396; 362/118; 362/120

(58) Field of Classification Search ..... 362/118, 362/120, 396
See application file for complete search history.

(56) References Cited

U.S. PATENT DOCUMENTS

| | | | | | |
|---|---|---|---|---|---|
| 2,410,535 | A * | 11/1946 | Van Daalen | ..... | 362/158 |
| 4,376,965 | A * | 3/1983 | Bacevius | ..... | 362/191 |
| 4,417,299 | A * | 11/1983 | Rupp | ..... | 362/186 |
| 5,303,133 | A * | 4/1994 | Wagner | ..... | 362/157 |
| 6,241,360 | B1 * | 6/2001 | Merrell | ..... | 362/99 |
| 6,666,566 | B1 * | 12/2003 | Uke | ..... | 362/202 |
| 7,040,783 | B1 * | 5/2006 | Christianson | ..... | 362/396 |
| 7,337,577 | B1 * | 3/2008 | Ramirez | ..... | 43/17 |
| 7,703,952 | B2 * | 4/2010 | Yoon | ..... | 362/396 |
| 7,850,329 | B2 * | 12/2010 | Henry et al. | ..... | 362/191 |
| 8,047,671 | B2 * | 11/2011 | Fan et al. | ..... | 362/119 |
| 2003/0227773 | A1 * | 12/2003 | Yang | ..... | 362/199 |
| 2009/0052167 | A1 * | 2/2009 | Ono | ..... | 362/103 |

* cited by examiner

*Primary Examiner* — Ismael Negron
(74) *Attorney, Agent, or Firm* — C. G. Mersereau; Nikolai & Mersereau, P.A.

(57) ABSTRACT

A lamp has a housing and a connecting device. The housing has at least one LED, a connecting section and a through hole. The at least one LED is mounted on the housing. The connecting section protrudes from the housing beside the at least one LED. The through hole of the housing is defined through the connecting section. The connecting device is connected with the connecting section and has a rod section which is mounted through the through hole of the housing.

3 Claims, 6 Drawing Sheets

LED LAMP WITH CLAMP ATTACHMENT ELEMENT

BACKGROUND OF THE INVENTION

1. Field of the Invention

The present invention relates to a lamp, and more particularly to a lamp which is conveniently used in an awkward or dark place.

2. Description of Related Art

When a hand tool is operated in an awkward or dark work place, a headlamp or a flashlight is needed for illumination. However, a light beam emitted from the conventional headlamp is easily blocked by hands or objects around the work place. The conventional flashlight has to be grasped by a hand during operation; therefore, the conventional lamps are not conveniently used in an awkward or dark place.

To overcome the shortcomings, the present invention tends to provide a lamp to militate the aforementioned problems.

SUMMARY OF THE INVENTION

The main objective of the invention is to provide a lamp which is conveniently used in an awkward or dark place.

A lamp has a housing and a connecting device. The housing has at least one LED, a connecting section and a through hole. The at least one LED is mounted on the housing. The connecting section protrudes from the housing beside the at least one LED. The through hole of the housing is defined through the connecting section. The connecting device is connected with the connecting section and has a rod section which is mounted through the through hole of the housing.

Other objects, advantages and novel features of the invention will become more apparent from the following detailed description when taken in conjunction with the accompanying drawings.

DETAILED DESCRIPTION OF PREFERRED EMBODIMENT

Figure 1:
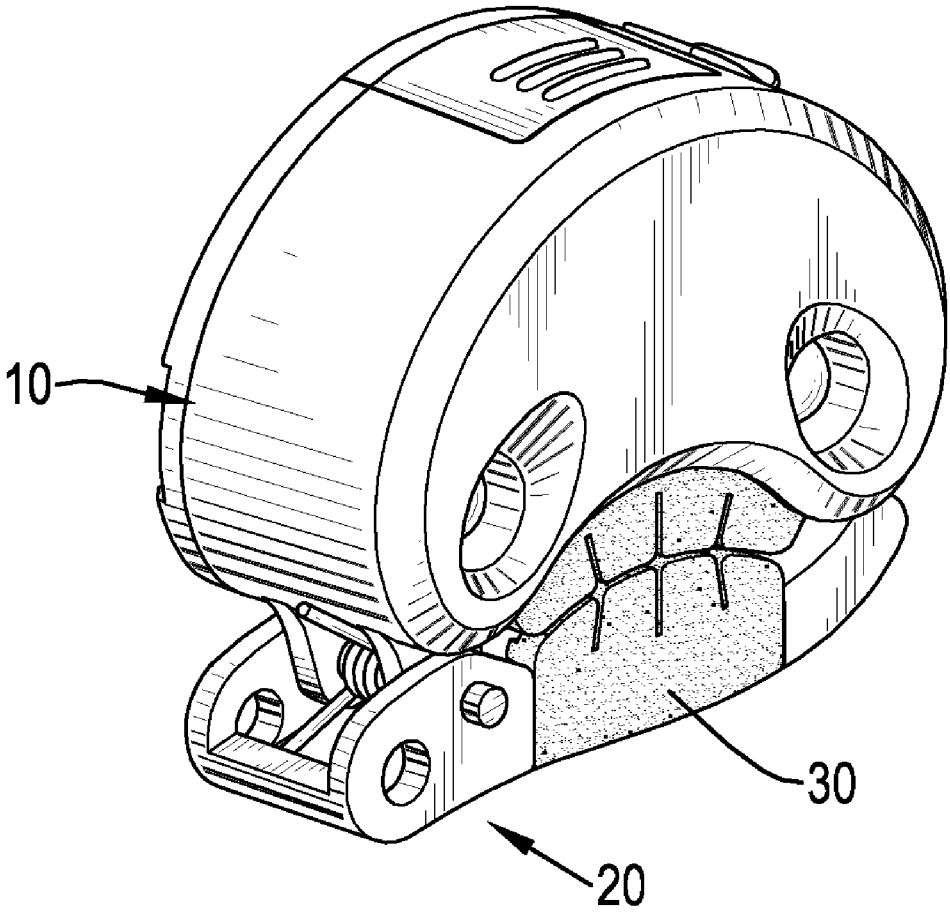
FIG. 1 is a front perspective view of a first embodiment of a lamp in accordance with the present invention.
Figure 2:
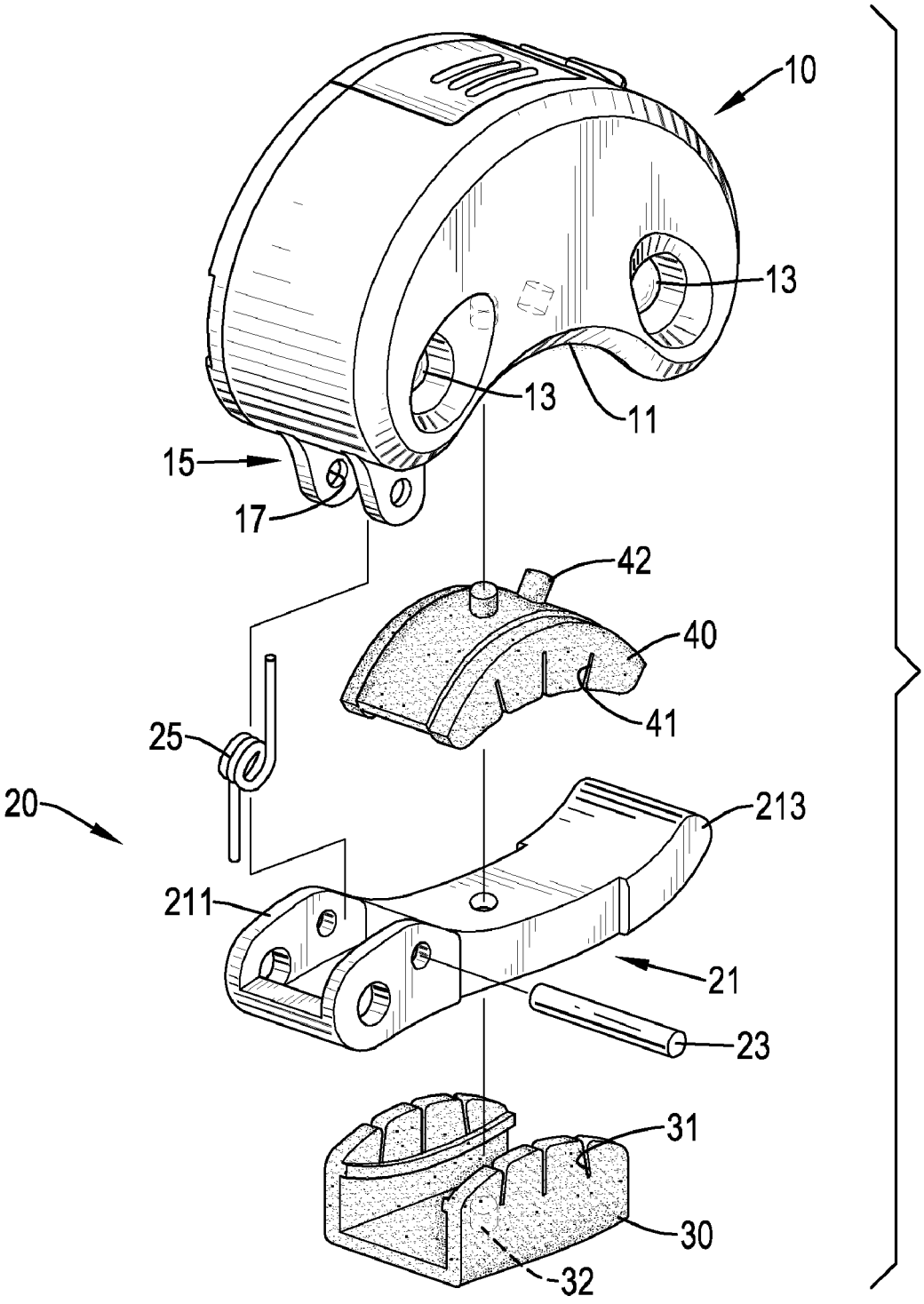
FIG. 2 is a partially exploded perspective view of the lamp in FIG. 1.
Figure 3:
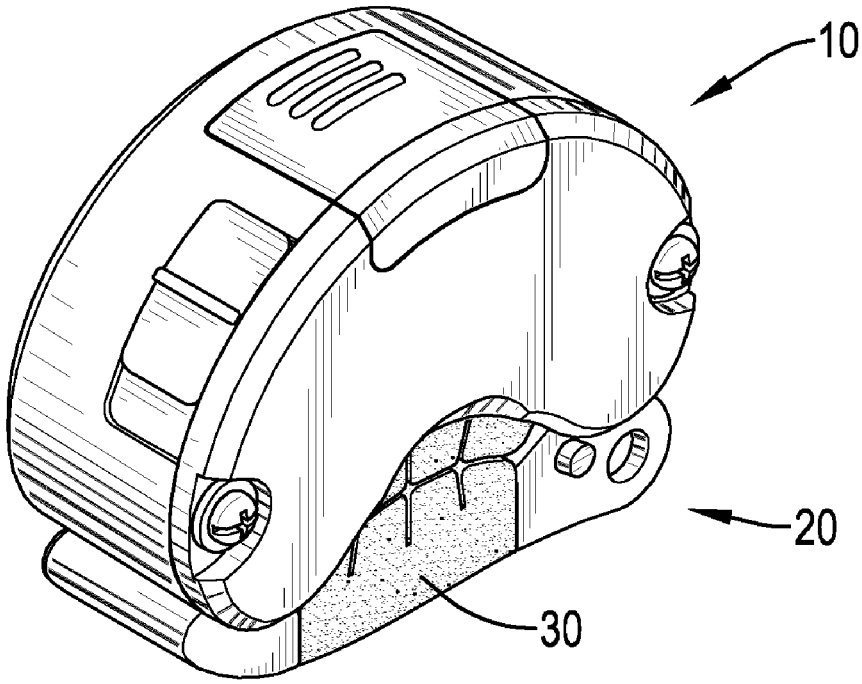
FIG. 3 is a rear perspective view of the lamp in FIG. 1.

With reference to FIGS. 1 to 3, a first embodiment of a lamp in accordance with the present invention comprises a housing (10), a connecting device (20), a first pad (30) and a second pad (40).

The housing (10) has a front side, a bottom, a concave (11), two LEDs (13), a connecting section (15) and a through hole (17). The bottom of the housing (10) has two ends. The concave (11) is formed between the ends of the bottom of the housing (10). The LEDs (13) are mounted on the front side of the housing (10). The connecting section (15) protrudes from the housing (10) beside the LEDs (13) and is formed on one of the ends of the bottom of the housing (10). The connecting section (15) is composed of two parallel tabs. The through hole (17) of the housing (10) is defined through the tabs.

The connecting device (20) is connected with the connecting section (15) and has an arm (21), a rod section and a torsion spring (25).

The arm (21) is pivotally connected with the connecting section (15) and has a pivot end (211), an abutting end (213) and a central segment. The pivot end (211) is connected pivotally to the connecting section (15) on the housing (10) and has a recess. The recess is defined in the pivot end (211) and has two inner sides which are parallel to and face each other. The inner sides of the recess of the pivot end (211) abut respectively the tabs. The abutting end (213) abuts the other end of the bottom of the housing (10). The central segment of the arm (21) is defined between the pivot end (211) and the abutting end (213). The central segment of the arm (21) has a bottom and a top facing the arm (21).

The rod section is a pin (23). The pin (23) is mounted through the pivot end (211) and the through hole (17) of the housing (10) to pivotally connect the arm (21) to the housing (10).

The torsion spring (25) is mounted around the pin (23) and is mounted between the tabs. The torsion spring (25) has two ends abutting respectively with the housing (10) and the pivot end (211).

The first pad (30) is elastic and has a U-shaped cross section. The first pad (30) is mounted securely on the bottom of the central segment of the arm (21) and has a lump (32). The lump (32) of the first pad (30) protrudes from the first pad (30) and is inserted into the bottom of the central segment of the arm (21). Preferably, the first pad (30) has two sides and multiple slots (31). The sides of the first pad (30) respectively extend toward the housing (10) and each side of the first pad (30) has a top above the top of the central segment of the arm (21). The slots (31) of the first pad (30) are respectively formed in the tops of the sides of the first pad (30).

The second pad (40) is curved, is elastic, is mounted securely in the concave (11) and has two lumps (42). The lumps (42) of the second pad (40) protrude from the second pad (40) and are inserted into the concave (11). Preferably, the second pad (40) has two sides and multiple slots (41). The sides of the second pad (40) respectively extend toward the arm (21). The slots (41) of the second pad (40) are respectively formed in the sides of the second pad (40) and are aligned respectively with the slots (31) of the first pad (30).

Figure 4:
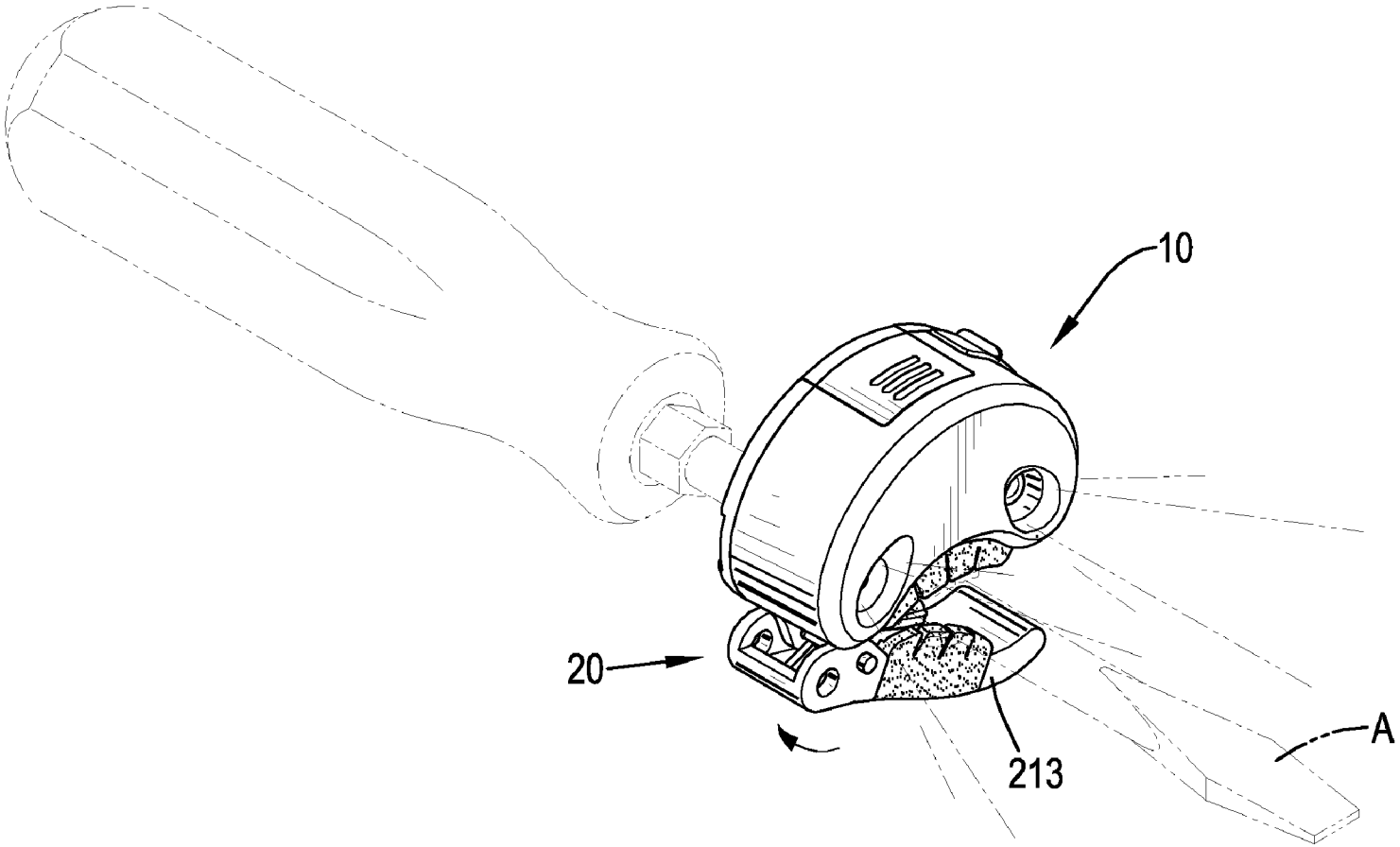
FIG. 4 is an operational perspective view of the lamp in FIG. 1, wherein a screwdriver is clamped.
Figure 5:
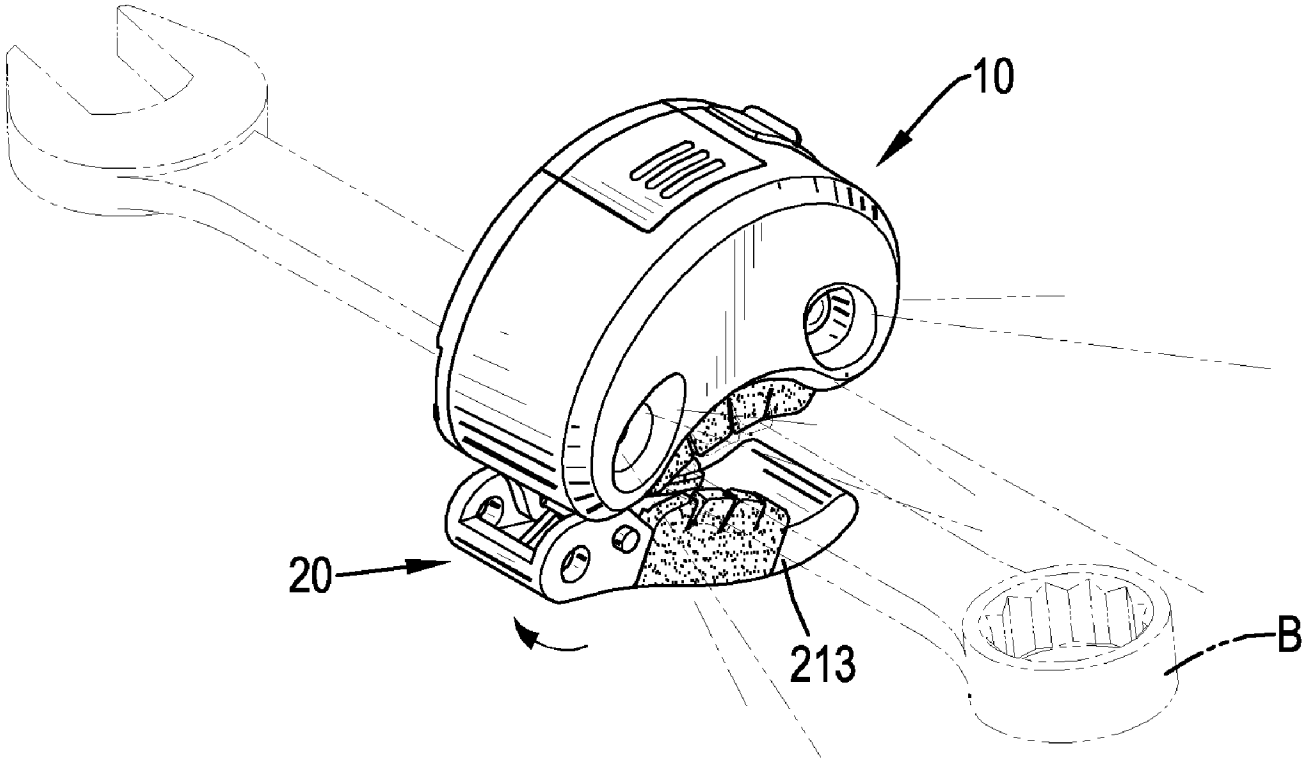
FIG. 5 is an operational perspective view of the lamp in FIG. 1, wherein a ring spanner is clamped.

With further reference to FIGS. 4 and 5, while the first embodiment of the lamp in accordance with the present invention is in use, the arm (21) is pivoted at the pivot end (211) to leave the abutting end (213) away from the housing (10). Consequently, the lamp is capable of clamping a screwdriver (A) or a ring spanner (B), so to hold the lamp with hands of a user is unnecessary. Because a light-projecting direction of the LEDs (13) faces directly toward a workpiece and the light beam emitted from the lamp is not blocked by hands or objects, the lamp is capable of providing sufficient illumination. Therefore, it is convenient to use a hand tool with enough illumination in an awkward or dark place.

Figure 6:
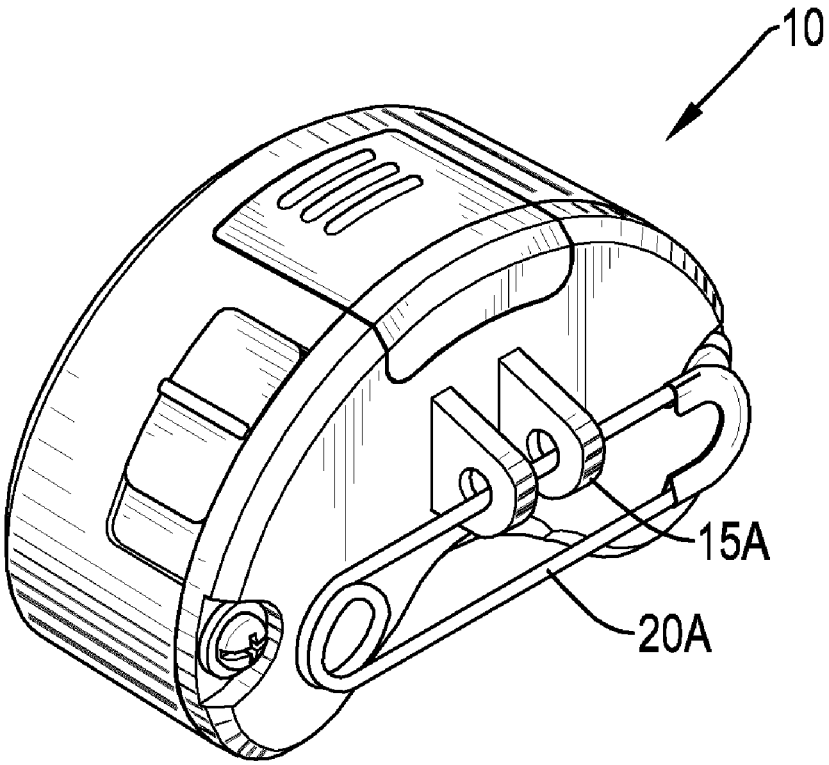
FIG. 6 is a rear perspective view of a second embodiment of a lamp in accordance with the present invention.

With reference to FIG. 6, a second embodiment of a lamp in accordance with the present invention has a housing (10) and a connecting device (20A). The housing (10) has a rear side, a connecting section (15A) and a through hole. The connecting section (15A) protrudes from the rear side of the housing (10). The through hole of the housing (10) is defined through the connecting section (15A). The connecting device (20A) is a safety pin. The connecting device (20A) has a rod section which is mounted through the through hole of the connecting section (15A). Therefore, it is convenient for users to wear the lamp by means of the connecting device (20A), and the lamp does not need to be grasped by a hand.

From the above description, it is noted that the present invention has the following advantages:

1. Convenience in Use in an Awkward or Dark Place:

The connecting device (20) allows the lamp in accordance with the present invention to clamp a hand tool. The light beam emitted from the lamp is not blocked by hands or objects. Therefore, it is convenient to use the hand tool with sufficient illumination in an awkward or dark place.

2. Easy Use without being Grasped by a Hand:

The lamp in accordance with the present invention can be conveniently clamped on a hand tool or worn on a user, so to hold the lamp with a hand is unnecessary.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp comprising:

a housing having a bottom having two ends;

a concave formed between the ends of the bottom of the housing;

at least one LED mounted on the housing;

a connecting section protruding from the housing beside the at least one LED and composed of two parallel tabs; and a through hole defined through the connecting section;

a connecting device connected with the connecting section and having a rod section which is a pin and is mounted through the through hole of the housing an arm pivotally connected with the connecting section, facing the concave and having a pivot end pivotally connected with and abutting the tabs and mounted through by the pin; and an abutting end abutting the housing;

a torsion spring mounted around the pin, mounted between the tabs and having two ends abutting respectively with the housing and the pivot end of the arm of the connecting device;

a first pad mounted securely on the arm and having two sides respectively extending toward the housing and each having a top above the arm; and multiple slots respectively formed in the tops of the sides of the first pad; and a second pad mounted securely in the concave and having two sides respectively extending toward the arm; and multiple slots respectively formed in the sides of the second pad and aligned respectively with the slots of the first pad.

2. The lamp as claimed in claim 1, wherein the pivot end of the arm of the connecting device has a recess which is defined in the pivot end and has two inner sides respectively abutting the tabs.

3. The lamp as claimed in claim 2, wherein the housing has a front side; two LEDs are implemented and are mounted on the front side of the housing.

* * * * *